United States Patent [19]

Hall et al.

[11] Patent Number: 4,695,200

[45] Date of Patent: Sep. 22, 1987

[54] MEMBRANE SEAL FOR A REMOVABLE BOTTOM FOUNDED STRUCTURE

[75] Inventors: Larry Hall, Birmingham, Ala.; John H. Goodacre, Glen Ellyn, Ill.

[73] Assignee: Chevron Research Company, San Francisco, Calif.

[21] Appl. No.: 869,525

[22] Filed: Jun. 2, 1986

[51] Int. Cl.[4] ..... E02B 17/00; E02D 21/00

[52] U.S. Cl. ..... 405/224; 405/195; 405/203; 114/296

[58] Field of Search ..... 405/203, 207, 208, 204, 405/195, 224; 114/296

[56] References Cited

U.S. PATENT DOCUMENTS

| | | | |
|---|---|---|---|
| 2,530,160 | 11/1950 | Finley . | |
| 2,657,661 | 11/1953 | Robson | 114/201 |
| 2,686,343 | 8/1954 | Harpoothian et al. | 49/477 |
| 2,720,011 | 5/1951 | Krupp . | |
| 2,937,006 | 5/1960 | Thayer | 405/207 X |
| 3,348,517 | 10/1967 | Johnson, Jr. et al. | 114/206 |
| 3,494,136 | 2/1970 | Wilms . | |
| 3,520,543 | 7/1970 | Etter et al. | 114/296 X |
| 3,701,500 | 10/1972 | Zeffer et al. | 244/103 R |
| 3,892,287 | 1/1975 | Bennett | 114/296 X |
| 3,896,628 | 7/1975 | Hansen | 405/207 |
| 3,961,490 | 6/1976 | Corgnet . | |
| 4,155,671 | 5/1979 | Vos | 405/203 |
| 4,425,055 | 1/1984 | Tiedemann | 405/217 |
| 4,521,133 | 6/1985 | Suzuk et al. | 405/195 |
| 4,522,532 | 6/1985 | Fedrick | 405/195 X |
| 4,576,518 | 3/1986 | Cooke et al. | 405/203 X |

FOREIGN PATENT DOCUMENTS 2247377 6/1975 France .

OTHER PUBLICATIONS

A. Della Greca, "New Concept of Offshore Drilling/-Production Arctic Platform and Dynamic Analysis . . . " 2/12-17/84 ASME, 1984.

Buslov et al., "Detachable Systems—Alternative Approach for Arctic Exploratory Structures", pp. 519-529.

Stenning et al., "Arctic Offshore Deepwater Ice Structure Interactions" OTC 3630, pp. 2356-2365.

G. Sebastiani et al., "Offshore Drilling and Production Platforms with Rapid Removal and Redeployment . . . ", pp. 631-642.

*Primary Examiner*—Dennis L. Taylor

*Attorney, Agent, or Firm*—E. J. Keeling; P. L. McGarrigle; V. A. Norviel

[57] ABSTRACT

The Removable Bottom Founded Structure (RBFS) is an offshore platform for petroleum drilling and producing operations which is deployed in waters with severe weather and iceberg conditions. The structure is normally held down by gravity, but during the deballasting procedure a hold-down system is employed to keep the platform on the subbase until site evacuation. The system that is used to hold the platform down onto the subbase is located where the platform meets the subbase. It operates on the principle of hydrostatics. On the underside of the columns, there are multiple chambers which may be evacuated by pumping and which are vented to the outside atmosphere. Flexible seals that define these chambers are positively engaged by water to create a fluid-tight seal so that no seawater will enter the evacuated chambers. The reduction of the buoyancy forces will hold the platform onto the subbase until such time as the platform is totally deballasted. Once that has occurred, the hydrostatic hold-down system is disengaged and the platform will quickly rise to the surface.

2 Claims, 6 Drawing Figures

$P_1 = \delta \cdot h_1 \cdot A$

SIMULATED NORMAL OPERATION
HOLDDOWN SYSTEM NOT ACTIVATED $P_2 = \delta \cdot h_2 \cdot A$

SIMULATED LIFT-OFF PROCEDURE
HOLDDOWN SYSTEM ACTIVATED $\delta$ = DENSITY OF $H_2O$
$h_1, h_2$ = HEIGHT OF $H_2O$ IN A TUBE
A = AREA OF BOTTOM OF COLUMN

MEMBRANE SEAL FOR A REMOVABLE BOTTOM FOUNDED STRUCTURE

CROSS REFERENCE TO RELATED APPLICATIONS

This application is related to applications having the Ser. Nos. 869,524, 839,492, 835,419, 835,420, 866,825, and 898,989, all assigned to the assignee of this application.

FIELD OF THE INVENTION

This invention generally relates to offshore oil drilling and producing structures. More specifically, to a hold-down/sealing system that is used on a structure for removably detaching that structure from a base located on the sea floor.

BACKGROUND OF THE INVENTION

As oil exploration continues in remote locations, the use of offshore drilling techniques and structures will become more commonplace in ice-infested areas. Platforms are continually erected in isolated areas that have extremely severe weather conditions. However, the structures that operate in more temperate climates cannot usually be employed here because they must be able to cope, not only with severe arctic storms and sea ice incursions, but also with large and small icebergs that are driven by wind, current and wave action. Because of these conditions, many different types of platform designs have arisen in an attempt to cope with the harsh weather and other natural elements.

Currently, much exploration is conducted in the arctic and in the ice-infested waters off Alaska, Canada, and Greenland. To cope with the iceberg and weather problem, some structures attempt to resist these large ice masses by simply being large enough to withstand the crushing forces. Examples of these designs may be seen in dual cone structures, such as U.S. Pat. No. 4,245,929, large reef-like structures, or many other gravity based large concrete-steel configurations. See also U.S. Pat. No. 4,504,172. However, these structures are either too heavy, expensive, or are permanently affixed to the bottom. As such, they do not lend themselves to either reuse or quick site evacuation in the case of an emergency situation.

Another design is a tension-leg platform (TLP) with disengageable or extensible legs as described in U.S. Pat. Nos. 3,955,521 and 4,423,985. These too have their inadequacies. The TLP maintains a stable floating position by its own buoyancy and the tendons that connect the structure to the sea floor. The allowable deck load for the TLP is limited due to its available buoyancy. Furthermore, there may be problems with icebergs that have drafts large enough to scour the sea floor. Most TLP structures have exposed wellheads and anchoring systems and thus would incur substantial damage if an iceberg of this size came along. Additionally, since the platform is naturally buoyant, the tendons are under constant tension which generally shortens the life of the tie down system.

Another factor to be considered is cost. Generally, the type of large gravity based structure that may be used for arctic exploration and production is very expensive and time consuming to build. With the unproven nature of some of the oil prospects, the harshness of the environment, the increased costs due to the weather down time, the probability of failure, and even the political climate, it becomes even more risky for an oil company to invest a large amount of money or time. In the event of an accident or other type of misadventure, losses could be greatly multiplied.

To overcome many of the disadvantages of these previously discussed arctic structures, it would be advantageous to combine some of the principles of the gravity-based structures with those of the floating structures. This is accomplished by constructing a platform that has subsurface hull chambers that may alternatively provide buoyancy or ballast and a subbase upon which the platform may rest. This structure may then be floated to a drilling or production site and slowly filled with ballast until both the platform and the subbase rest on the sea floor. When a situation, threatening to the structure, presents itself, the platform may be deballasted and removed from the site to leave the subbase behind. However, this deballasting procedure is quite slow (on the order of 6 to 7 hours) and since it is probably going to be done in rough seas, there is a large chance that the structure may be damaged when it "bounces around" as it approaches neutral buoyancy, but before it reaches its floating draft.

A solution to this problem is to keep the platform down on the subbase with a hold-down means while it is deballasting. Once it has fully deballasted, the hold-down means may then be released to allow the platform to quickly ascend to its floating draft and escape damage.

This hold-down system may be mechanical or hydraulic, however, because a mechanical system: may not assure a simultaneous release of all mechanical systems; is expensive; and difficult to re-use, a hydrostatic sealing system is chosen. This hydrostatic system will hold the structure to the base from the beginning of the deballasting procedure to the time when deballasting is complete. When this occurs, the structure may be quickly detached by releasing the seal and then floated away from the impending danger.

To eliminate most of the problems of these previously mentioned arctic structures for use in iceinfested waters, the Removable Bottom Founded Structure (RBFS) was developed to provide a platform which may be removably detached from its base and, if necessary, transported to a safer location.

SUMMARY OF THE INVENTION

The present invention holds a buoyant platform onto a subbase that rests on the sea floor. The platform is called a Removable Bottom Founded Structure (RBFS) and it is designed for the arctic environment. The RBFS resembles a very large submersible drilling platform which, by virtue of its direct access to the wells, functions in many ways like a conventional fixed drilling and production platform. Normally, the platform would be fully ballasted on the subbase with a combination of water and solid ballast. However, in the event of an approaching iceberg (larger than one which the RBFS is designed to resist), the sealing system is engaged, the platform is deballasted to a positive buoyancy condition, the risers are disconnected from the subbase, then the sealing system is released, and the platform floats and propels itself off location to leave the subbase behind. The platform must disconnect from the subbase and reach its floating draft very quickly to avoid potential collision between the platform and subbase. The hold-down system keeps the platform down on the subbase, and when the columns and braces are deballasted to achieve a large net buoyant upward force, the hold-down mechanism is quickly released to lift off the platform.

To provide an appropriate hold-down mechanism, a sill on the subbase, in combination with a membrane seal and a bladder behind the seal, establishes a fluid-tight barrier. Once there is a fluid-tight barrier, the hydrostatic head in the area underneath the platform may be reduced to keep the platform on location. The platform stays in place during this time by effectively removing the buoyancy forces from the underside of the columns; thus the platform alone holds itself down as if it were not resting on water.

DETAILED DESCRIPTION OF THE INVENTION

The Removable Bottom Founded Structure (RBFS) is an offshore structure for petroleum drilling and producing operations and is intended for deployment in waters with severe weather and ice-infested conditions. The RBFS is a two-part structure. The first part generally comprises a platform and is made up of multiple columns which are affixed to a deck structure. The second component is a reinforced concrete subbase that rests on the sea floor and upon which platform is founded.

The RBFS is designed to withstand severe conditions of wind, wave and current action, and many of those ice conditions which could normally be expected during the structure's life. For example, the RBFS was designed to withstand a 150-year return period storm; an iceberg with a 20-year return period kinetic energy; and to survive (with some damage) an impact with an iceberg having a 100-year return period kinetic energy. However, if an iceberg large enough to cause damage to the RBFS threatens to come in contact with the structure, the platform is evacuated from the site to leave the subbase behind. To ensure that the inhabitants and operators of the RBFS are apprized of all iceberg and storm dangers, they maintain visual lookouts for good days and shorter distances, whereas they use a radar system for longer distances and less clear weather. Danger zones, having specified radii, may also be established to allow the platform personnel to gauge the possibility of actual iceberg incursion.

Figure 1:
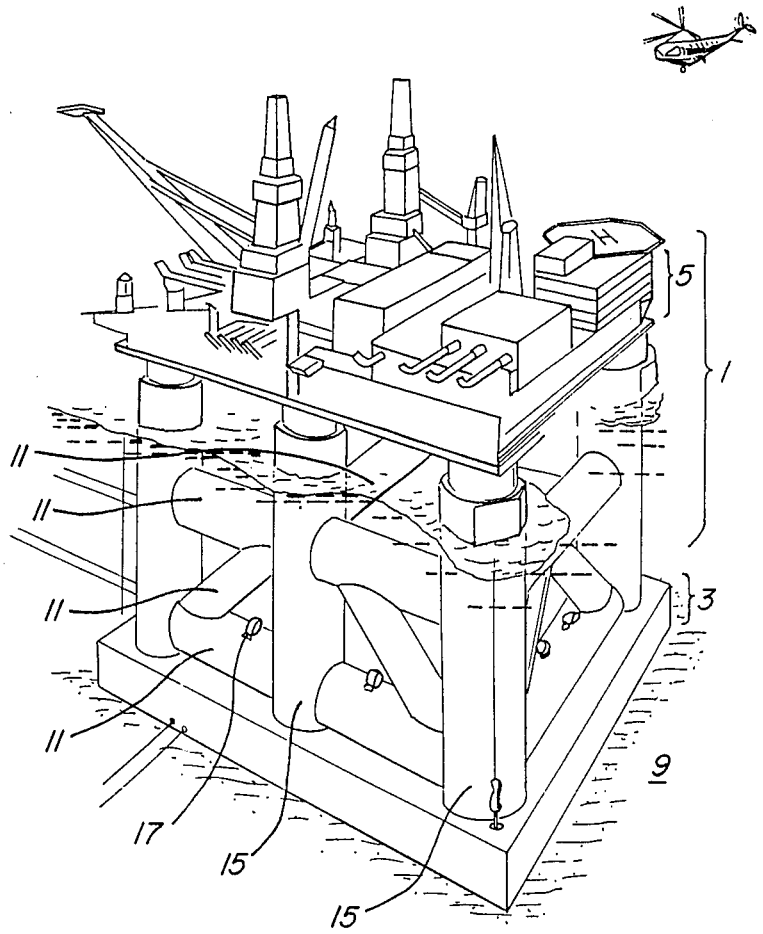
FIG. 1 is a view of the assembled platform and the subbase.

FIG. 1 shows that the RBFS comprises two portions, a platform 1 and a subbase 3. The platform 1 is comprised of a deck 5, columns 15, and braces 11. The subbase 3 is affixed to the sea floor and provides a surface to receive axial and lateral loads from the platform 1.

The subbase 3 is a permanent reinforced concrete structure, the configuration of which is generally shown in FIG. 1. It is designed to withstand a 100-year iceberg impact with practically no movement and no structural damage and is able to survive a 2000-year iceberg (while protecting a subsea template) with limited damage and movement. The subbase 3 provides a bearing surface for vertical and lateral load transfer from the platform 1 and protects the well template from iceberg scour.

Figure 2:
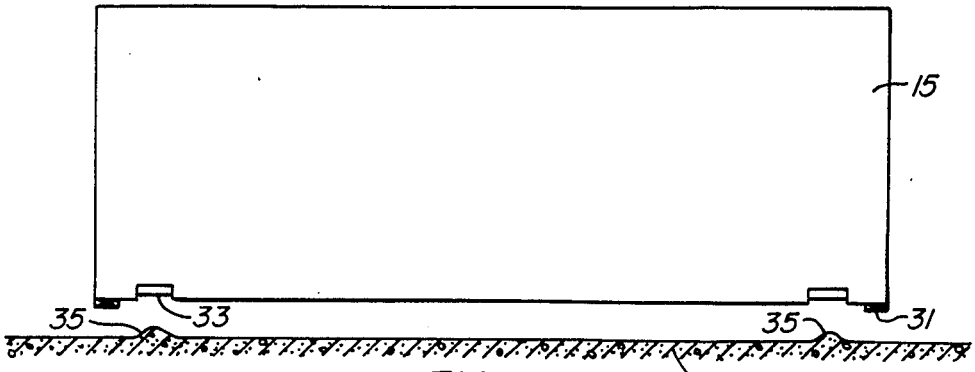
FIG. 2 is a cross-sectional view of the lower portion of the column.
Figure 2A:
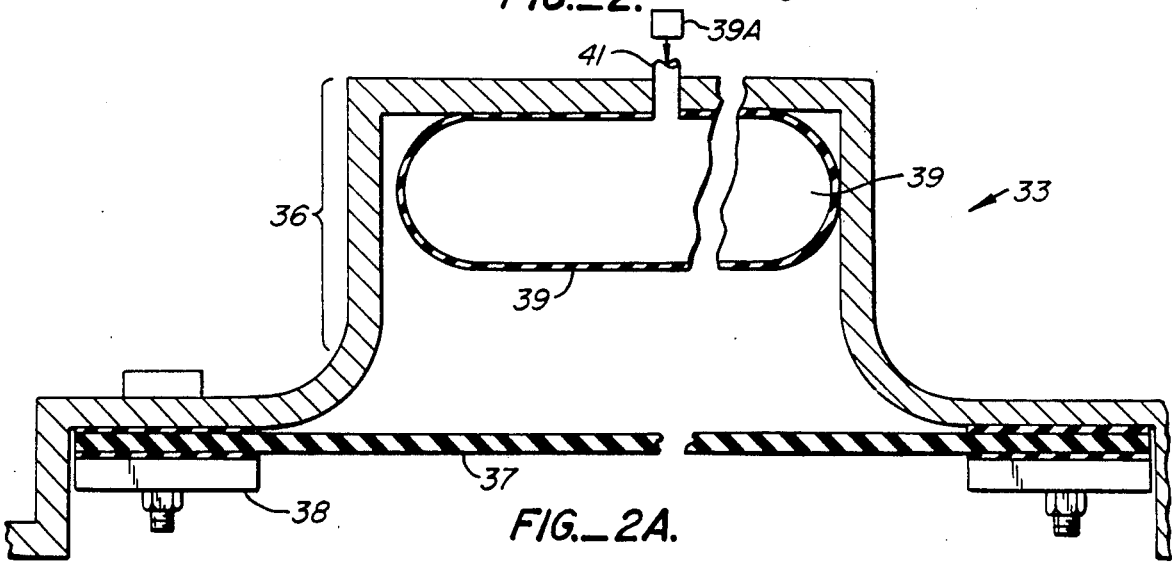
FIG. 2*a* is an enlarged cross-sectional view of a single membrane seal.

As shown in FIG. 2 there is a sill 35 in the upper surface of the subbase 3 that conforms to an open chamber 36 in the area underneath the column 15 in order that a sealing system may have a place to contact. The subbase 3 resists sliding and has sufficient mass and dimension to either ground out or deflect any iceberg. A well template is recessed within the interior of the subbase 3 along with some wellheads. There may be one, centrally located well template or there may be more than one template which could be offset from center. Consequently, this low profile design enables the subbase 3 to protect the wellheads from icebergs in the event that one does come along that is large enough to scour the sea floor.

The subbase 3 is permanent. When the platform 1 is on location, the subbase 3 provides a bearing surface for vertical and lateral load transfer from the platform 1. After platform 1 removal, the subbase 3 will protect the subsea template from deep draft icebergs.

In one method for installation of the RBFS, the subbase 3 (as the foundation) is affixed to the sea floor by many of the means used for gravity based structures, such as; cementing, grouting, or even by its own weight. Once the subbase 3 is installed, structure 1 may be floated over to and lowered down on top of it so that the open chamber 36 in the area underneath the column 15 is aligned with the sill 35 on the subbase 3 (This mating may be accomplished by an acoustic or a mechanical system to accurately join the lower surface of the platform 1 onto the upper surface of the subbase 3.) The platform 1 is lowered by selective admission of ballast into the interior of the members (i.e., columns 15, etc.) and the platform 1 remains on the subbase 3 by shear gravity. This ballast will be seawater. The only requirement is that the platform 1 may be properly weighted down on the subbase 3 to provide sufficient resistance to all possible platform movements (i.e., rocking) due to wave action. At this point, the entire structure (i.e., the platform 1 and subbase 3) is stable and connection of the risers may begin.

There may be times when the platform 1 will have to be moved from its location due to a threatening iceberg. However, before it can be moved, it must be deballasted. As mentioned before, if it is deballasted and permitted to slowly rise off the subbase, rough waters may cause the platform 1 to come in contact with the subbase 3. This could damage both the platform 1 and the subbase 3, and may even go so far as to cause the platform 1 to flood and sink. As a result, the platform 1 is held down onto the subbase 3 by a hydrostatic hold-down system while it is being deballasted. Once all the liquid ballast has been removed, the sealing system may be disengaged and the platform 1 allowed to rise to its floating draft in a rapid fashion.

FIG. 2 shows a cross-sectional view of the RBFS hydrostatic hold-down system which is designed to be fitted underneath a column 15. There is an outer seal 31, which may be a bearing plate. It serves to transfer axial loads from the platform 1 to the subbase 3 and may perform some water sealing functions. The inner, main seal is a membrane seal 33. The membrane seal 33 is arranged in a closed circle on the underside of the perimeter of the column 15. On the upper surface of the subbase 10 there is a sill 35 that, as described earlier, is also arranged in a closed circle to exactly match the seal 33 in the underside of the column 15. As shown in FIG. *2a* there is a recessed chamber 36 in the underside of the column 15 that houses the seal 33. A membrane 37 fits across the opening of the recessed chamber 36 with 25 mm "T" bolts and a segmental bolting bar 38. An inflatable bladder 39 is in the recessed chamber 36 behind the membrane 37. A means 39A to inflate the bladder 39 is attached by a pressure connection 41. As the platform 1 sits on the subbase 3 there is a space 43 between the upper surface 10 of the subbase 3 and the lower surface of the supporting member, i.e., the column 15.

As the platform 1 sits onto the subbase 3 the sill 35 deflects the membrane 37 upward and deforms the inflatable bladder 39. It is in this position that the bladder 39 will remain until it is needed during deballasting when the hydrostatic sealing system may be engaged as follows. The means 39A to inflate the bladder 39 is attached to the inflatable bladder 39 by pressure line 41, and it pressurizes the bladder 39. (Any one of a number of means known to one skilled in the art may be used to generate pressure and will not be recited here, i.e., a pneumatic or hydraulic pump or simply by a gravity water feed.) Now, referring to FIG. 3, as the bladder 39 is inflated it pushes against the membrane 37 which presses against the sill 35 to create a fluid-tight seal ($P_1$ is equal all the way around). Once this seal has been created, the space 43 (defined by the upper surface of the subbase 3, the lower surface of the column 15, and the circular seal 33) is dewatered (or evacuated). FIG. 4 shows the bladder 39 and membrane 37 when the pressure is lowered (e.g., $P_2$) in the space 43 behind the seal 33. Here, even though the seal 33 is deflected inward, an effective fluid-tight seal is maintained. (The means for evacuating the water from the space 43 is also known to those skilled in the art and will not be recited here.) Evacuating the space 43 behind the fluid-tight seal reduces the hydrostatic pressure underneath the column. It is this reduced hydrostatic pressure that reduces the buoyancy and keeps the platform 1 on location during deballasting.

Figure 5:
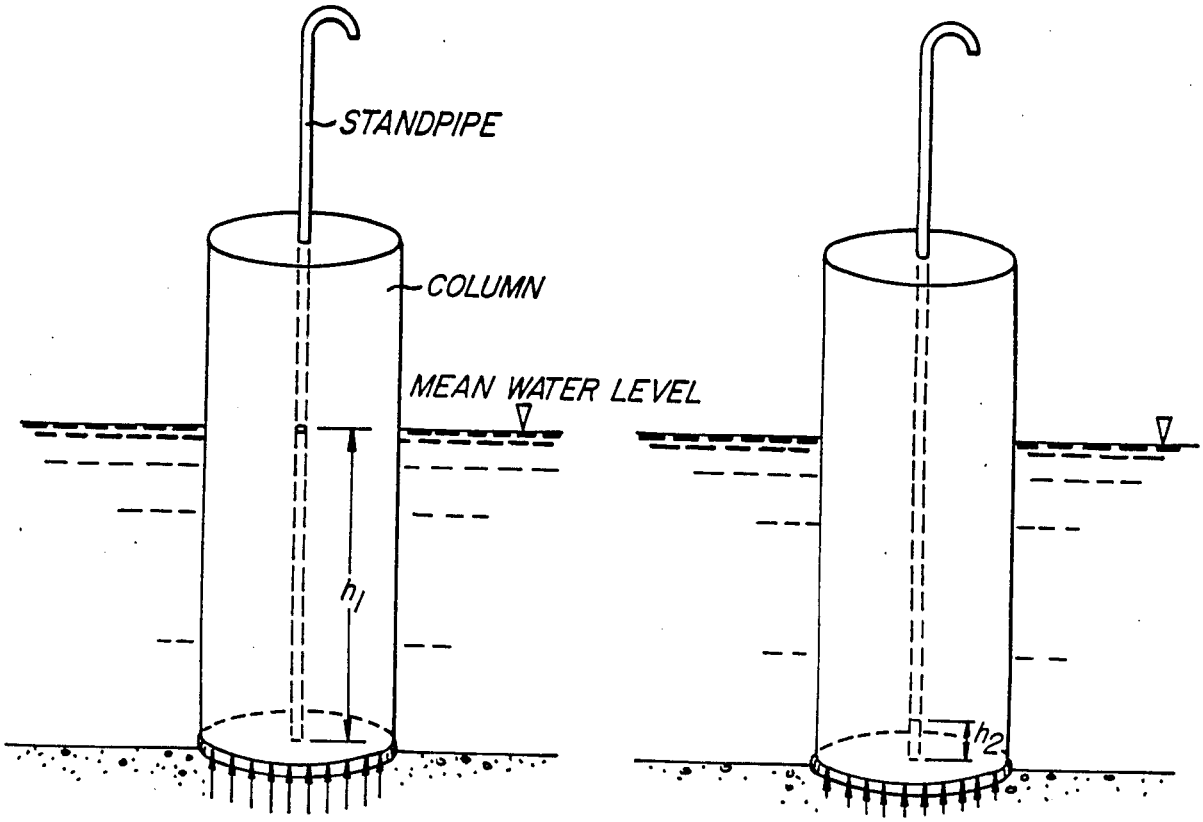
FIG. 5 represents the forces that act on the underside of a buoyant column.

The seal 33 holds the platform 1 to the subbase 3 by reducing the hydrostatic head on the area underneath the column 15. This is shown in FIG. 5, which represents the buoyancy forces acting on a column before and after the sealing system is engaged. In normal states the buoyant force that acts on a column may be shown by $P_1=\delta \cdot h_1 \cdot A$, where $P_1$ is the total buoyant force, $\delta$ is the density of water, $h_1$ is the height of water in a standpipe, and A is the area underneath the column. However, operation of the hold-down system reduces the water level in the standpipe to $h_2$. This decreases the buoyant force to a new value which can be expressed as $P_2=\delta h_2 A$. The difference in hydrostatic pressure between the outside environment and the area underneath the column 15 is maintained by the seals around the perimeter of the column 15 which holds the platform 1 down onto the subbase 3.

Figure 3:
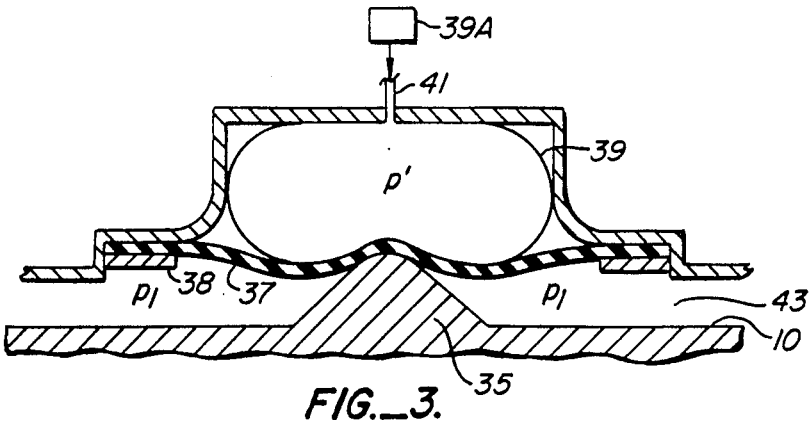
FIG. 3 is a cross-sectional view of the deployed hold-down sealing system.
Figure 4:
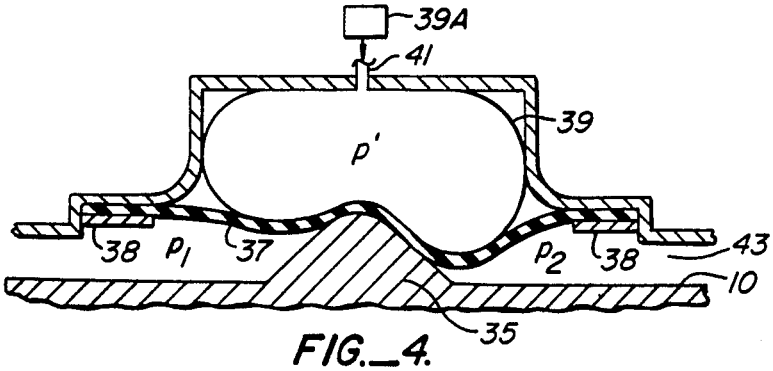
FIG. 4 is a cross-sectional view of the deployed sealing system where the pressure is reduced on one side of the seal.

As recited previously, the hold-down system is shown in FIGS. 2–4. The circularly arranged seal 33, on the underside of the column 15, encloses a space 43 between the column 15 and the subbase 3. During normal platform operation, when the RBFS behaves as a gravity structure and a hold-down force is not needed, the space 43 is open to the ambient hydrostatic pressure (i.e., $P_1$). As the platform 1 is deballasted and becomes more buoyant, the hydrostatic pressure in the space 43 is reduced to create a hold-down force (i.e., $P_2$). The hold-down force equals the product of the plan area of the space 43 and the differential pressure across the seal 33 which is $\Delta P=\delta(h_1-h_2)$ (the differential pressure is the ambient hydrostatic pressure at the top of the subbase 3 less the pressure in the space 43 which corresponds to the water level in the space 43). The hold-down force under the column 15 is sufficient to prevent platform 1 lift-off under the combined effects of the buoyancy of the deballasted platform 1 and the design storm loads. The hold-down force is deactivated by opening the space 43 to the ambient hydrostatic pressure.

Operation of the hydrostatic hold-down system is not necessary for the RBFS during normal operating conditions (because it is normally held in place by gravity), however, the seals would be frequently tested for leaks. Prior to evacuation the seals 33 are engaged, and the platform 1 is deballasted by pumping out the ballast chambers in the columns 15 and braces 11. The pumps are sized to deballast the entire platform 1 in five hours. Redundant control of ballast tanks from several independent pumps is designed into the system, and ballast control is fully automated with manual backup.

If the sealing system is effective, then essentially all the water in the space 43 will be removed. A float valve (not shown) may be used to turn off a pump when the water is gone and may reactivate the pump in the event of water leakage into the space 43. While the platform 1 is being fully deballasted and the seal 33 has been engaged, the various mechanical systems are prepared for liftoff.

Since the RBFS can evacuate the site on impending impact of a large iceberg, all piping and control lines between the platform 1 and subbase 3 are readily disconnectable. (None of the following material is illustrated.) Therefore, the next step before site evacuation is to hydraulically disengage the riser mechanical latching system to lift the entire integrated riser bundle into the column 15 by means of hydraulic hoists. The production and injection wells and oil sales lines are shut in subsea and all lines in the integrated riser are purged with seawater. This is the final preparatory step in the liftoff procedure.

The platform 1 may lift off the subbase 3 by destroying the difference in the hydrostatic pressure between the space 43 and the ambient seawater pressure at that depth. To equilibrate the pressure in the space 43 to that of the ambient seawater, additional pressure may be used from such things as pumps, etc., but an easier way to perform this task would be to allow water, at that depth, to flow into the space 43 from the outside. Once that is done, the pressure on both sides of the seal 33 will be equal and the natural buoyancy of the platform 1 will cause the platform 1 to rise.

Immediately after the platform 1 lifts off the subbase 3, the platform 1 may move away under positive navigational control achieved with a thruster system built into the platform 1. Thrusters 17 (see FIG. 1) may be positioned at locations on the platform 1 to steer it in a controlled manner, but cannot station keep in severe storm conditions. Tugs in the vicinity (for iceberg towing, surveillance and other purposes) provide further steering control once sea conditions permit attachment of towing lines.

When sea and ice conditions again permit, the platform 1 is resited on the subbase 3 and platform 1 is reballasted. The integrated riser bundle is stabbed into its receptacle in subbase 3, hydraulic hoists stab a riser connector down onto a connector mandrel, and the integrated riser is reconnected to the wellhead. Drilling risers are also reattached to the well template through a centrally located moon-pool and the normal operations resume.

Since many modifications and variations of the present invention are possible within the spirit of this disclosure, it is intended that the embodiments disclosed are only illustrative and not restrictive. For that reason, reference is made to the following claims rather than to the specific description to indicate the scope of this invention.

What is claimed is:

1. A sealing apparatus to affix a gravity founded, movable offshore structure onto a subbase that rests on the sea floor, during the time when the movable structure is being deballasted to prepare for rapid site removal, comprising:

a movable offshore platform;

at least one load bearing member to support the platform, the member is fixedly connected to the platform and extending in a generally downward direction from the platform;

a generally flat surface on the underside of the member;

a subbase to provide support to the platform;

a generally flat upper surface on the subbase to support the at least one member on the upper surface of the subbase;

a raised sill located on the upper surface of the subbase on which the columns will sit, the sill being arranged in a substantially circular closed loop;

an indented portion in the member, corresponding to the sill configuration so that both the sill and the indented portion will match each other when the member is placed on the subbase;

a flexible seal attached to the sides of the indented portion so that there is a fluid-tight inside chamber in the indented portion;

an inflatable bladder within the fluid-tight inside chamber of the indented portion;

means to inflate the bladder;

means to support substantially all of the platform weight;

means to establish a space between the subbase and the member; and means to evacuate the space between the member and the subbase to create a lower hydrostatic pressure within the space than the surrounding seawater;

so that as the member sits on the subbase, the sill deflects the flexible membrane, and once the bladder is inflated it seals off the space between the member and the subbase from the outside sea environment, so that the structure will be held down onto the subbase once the hydrostatic pressure within the space is reduced to a pressure that is lower than the surrounding seawater.

2. The sealing apparatus as recited in claim 1 where the means to inflate the bladder uses water pressure.

* * * * *